US006438972B1

(12) United States Patent
Pickett, Jr. et al.

(10) Patent No.: US 6,438,972 B1
(45) Date of Patent: Aug. 27, 2002

(54) VESSEL ASSEMBLY AND RELATED MANUFACTURING METHOD

(75) Inventors: Paul M. Pickett, Jr., North Branch; Lowell D. Sasser, Jr., White Lake, both of MI (US)

(73) Assignee: Automotive Fluid Systems, Inc., Troy, MI (US)

( * ) Notice: Subject to any disclaimer, the term of this patent is extended or adjusted under 35 U.S.C. 154(b) by 0 days.

(21) Appl. No.: 09/942,331

(22) Filed: Aug. 29, 2001

(51) Int. Cl.[7] ..... F25B 47/00
(52) U.S. Cl. ..... 62/85; 62/474; 62/503
(58) Field of Search ..... 62/474, 475, 503, 62/509, 85, 471; 96/147, 153, 121; 55/507, 504, 509; 210/282, 287, 288; 137/590

(56) References Cited

U.S. PATENT DOCUMENTS

| | | | | |
|---|---|---|---|---|
| 2,691,873 | A | | 10/1954 | Skoli et al. |
| 2,953,906 | A | | 9/1960 | Quick |
| 3,643,465 | A | | 2/1972 | Bottum |
| 3,872,689 | A | | 3/1975 | Bottum |
| 4,182,136 | A | | 1/1980 | Morse |
| 4,199,960 | A | | 4/1980 | Adams et al. |
| 4,270,934 | A | | 6/1981 | Widdowson et al. |
| 4,291,548 | A | | 9/1981 | Livesay |
| 4,331,001 | A | | 5/1982 | Jones |
| 4,354,362 | A | | 10/1982 | Schumacher et al. |
| 4,405,347 | A | | 9/1983 | Cullen et al. |
| 4,457,843 | A | | 7/1984 | Cullen et al. |
| 4,474,035 | A | | 10/1984 | Amin et al. |
| 4,509,340 | A | | 4/1985 | Mullally et al. |
| 4,619,673 | A | | 10/1986 | Cullen et al. |
| 4,633,679 | A | | 1/1987 | Wintersteen |
| 4,675,971 | A | | 6/1987 | Masserang |
| 4,768,355 | A | | 9/1988 | Breuhan et al. |
| 4,827,725 | A | | 5/1989 | Morse |
| 4,866,951 | A | | 9/1989 | Masterson, II |
| 4,920,766 | A | | 5/1990 | Yamamoto et al. |
| 4,938,037 | A | | 7/1990 | Carlisle, Jr. |
| 4,994,185 | A | | 2/1991 | Cullen et al. |
| 5,076,066 | A | | 12/1991 | Bottum |
| 5,076,071 | A | | 12/1991 | Morse |
| 5,177,982 | A | | 1/1993 | Plemens |
| 5,184,479 | A | | 2/1993 | Koberstein et al. |
| 5,191,775 | A | | 3/1993 | Shiina et al. |
| 5,201,792 | A | | 4/1993 | Study |
| 5,233,842 | A | | 8/1993 | Manning et al. |
| 5,282,370 | A | | 2/1994 | Kiblawi et al. |
| 5,347,829 | A | | 9/1994 | Newman |
| 5,375,327 | A | | 12/1994 | Searfoss et al. |
| 5,590,542 | A | * | 1/1997 | Wang ..... 62/457.3 |
| 5,660,058 | A | | 8/1997 | Harris et al. |
| 5,746,065 | A | | 5/1998 | Patel et al. |
| 5,778,697 | A | | 7/1998 | Wantuck |
| 5,799,830 | A | * | 9/1998 | Carroll et al. ..... 222/95 |
| 5,906,112 | A | | 5/1999 | Amin et al. |
| 5,970,738 | A | | 10/1999 | DeNolf et al. |

* cited by examiner

*Primary Examiner*—Chen-Wen Jiang
(74) *Attorney, Agent, or Firm*—Vanophem & Vanophem, P.C.

(57) ABSTRACT

A vessel assembly and related assembly method that includes a flexible J-tube assembly that bends in compliance during assembly to a vessel to ensure locating of a filter unit against an inside bottom surface of the vessel while accommodating longitudinal part tolerances greater than that of the prior art. The flexible J-tube assembly is disposed within the interior of the vessel such that an upper end of the flexible J-tube assembly is connected to an inside top portion of the vessel, and a distal end of the flexible J-tube assembly is located against the inside bottom surface of the vessel. The resiliency of the flexible J-tube assembly permits the distal portion of the flexible J-tube assembly to stay located against the inside bottom portion of the vessel regardless of longitudinal dimensional variations of the flexible J-tube assembly and the vessel.

12 Claims, 1 Drawing Sheet

VESSEL ASSEMBLY AND RELATED MANUFACTURING METHOD

BACKGROUND OF THE INVENTION

1. Field of the Invention

The present invention generally relates to refrigerant pressure vessels for use in refrigeration systems, such as a receiver-dryer or an accumulatordehy-drator. More specifically, this invention relates to an automotive accumulator assembly that has a unique outlet tube and to a related method of manufacturing the accumulator assembly to achieve a more tolerant product design and assembly process.

2. Description of the Related Art

The use of pressure vessels in refrigeration systems, particularly automotive air-conditioning systems, is very well known. A typical refrigeration system includes a compressor, a condenser, an expansion device, an evaporator, and conduits therebetween. Additionally, an accumulator-dehydrator or a receiver-dryer unit is also usually included as will be described below. The compressor compresses liquid refrigerant into high-pressure, high-temperature vapor or gas refrigerant (e.g. 200 PSI at 150° F.) and outputs the gas refrigerant as a superheated vapor through a high-pressure section of the conduit to the condenser. The condenser is typically constructed in the fashion of a tube-and-fin type heat exchanger. Within the condenser, the heat of the gas refrigerant flows through tubes and is released to or absorbed by outside air flowing around fins in contact with the tubes. As the gas refrigerant loses heat to the surrounding air, the high-pressure, high-temperature gas refrigerant cools and condenses into high-pressure, moderate temperature liquid refrigerant.

Subsequently, the liquid refrigerant passes through another high-pressure section of the conduit to the expansion device, which expands the compressed liquid refrigerant, thereby further cooling the liquid refrigerant into a low-pressure, low temperature liquid/gas refrigerant mixture (e.g. 40 PSI at 50° F.). Subsequently, the cooled liquid/gas refrigerant mixture is conveyed from the expansion device to the evaporator through a low-pressure section of the conduit. The evaporator is also typically constructed in accordance with a tube-and-fin type heat exchanger. Within the evaporator, the liquid/gas refrigerant mixture absorbs heat from fan-blown air passing around fins of the evaporator. The fan-blown air is thereby cooled and passed into a living space to be cooled. As the liquid/gas refrigerant mixture absorbs heat from the surrounding ambient air, the low-pressure, low-temperature liquid/gas refrigerant mixture warms and evaporates into a low-pressure, low-temperature gas refrigerant. The gas refrigerant is then conveyed back to the compressor through a final section of the conduit to complete the circuit of the refrigeration system.

In most refrigeration systems, it is common to use one or the other of a receiver-dryer or an accumulator for various benefits. A receiver-dryer is typically located at the outlet end of the condenser in the pressure-side section of the refrigeration circuit. In contrast, an accumulator-dehydrator is typically located at the outlet end of the evaporator in the suction-side section of the refrigeration circuit. The receiver or accumulator is used for i) removing water from the refrigerant fluid, ii) screening out particulate matter, and iii) acting as a reservoir for the refrigerant fluid when refrigeration system demand is low. Additionally, an accumulator is used for iv) lubricating gaseous refrigerant with a prescribed amount of lubricating oil, and v) separating moisture-laden, partially vaporized refrigerant fluid into a moisture-free refrigerant vapor having a certain lubricating oil content. For an accumulator, it is important to separate and lubricate the refrigerant so as to provide a lubricated moisture free gas refrigerant to the inner workings of the compressor to keep the compressor in proper working condition.

It has been a major challenge in the prior art to design and manufacture such devices that operate efficiently and that are inexpensive and easy to manufacture. Traditionally, a receiver-dryer or accumulator-dehydrator is made of metal components, often aluminum, that have a sufficiently high strength to withstand the relatively high pressure within the refrigeration circuit. Within typical receiver-dryers and accumulator-dehydrators there are some similar components. Of primary concern are outlet tubes and oil pickup filters attached thereto. Various types of outlet tubes and oil pickup filters therefor have been used in refrigerant vessel designs for many decades. Such systems typically include the outlet tube having an open intake end disposed in an upper gaseous portion of the accumulator above the level of any liquid refrigerant therein. Some outlet tubes extend downwardly from the open intake end and are U-shaped such that an intake leg extends roughly parallel to an outlet leg of the outlet tube. Other outlet tubes, such as used in refrigerant receivers, have their open intake end disposed proximate the bottom of the receiver that terminates in a filter unit. Still other outlet tubes are of single-leg, dual-channel design having a downflow channel and an upflow channel disposed side by side, wherein the outlet tube terminates in a filter unit disposed in a distal portion of the vessel.

It has long been known that it is important with all of these designs that the pickup filter be located at or as near the bottom of the accumulator as practicable. For example, it was taught in U.S. Pat. No. 2,953,906 to Quick to extend a capillary tube or pickup tube through an opening in a lowermost bight portion of a U-shaped outlet tube. A discharge end of the capillary tube extends upwardly into the outlet tube and an oppositely disposed intake end extends exteriorly of the outlet tube. The intake end of the pickup tube extends downwardly and terminates in a screen portion that rests on the bottom of the container for picking up a controlled amount of liquid refrigerant and oil.

Subsequently, U.S. Pat. No. 4,199,960 to Adams et al. taught an accumulator having telescoped sections of straight tubes that replace the conventional U-shaped tube to enable using a container having a smaller diameter. Adams et al. disclosed the accumulator container as having a closed bottom wall and a pair of telescoped tubes extending upwardly from the closed bottom wall. A lower end of the telescoped tubes fits within a filter or cage having a disk that rests directly on the closed bottom wall. During operation, oil in the refrigerant settles out at the bottom of the container and is picked up through the filter that rests on the bottom of the container.

U.S. Pat. No. 4,920,766 to Yamamoto et al. and U.S. Pat. No. 5,191,775 to Shiina et al. disclose a refrigerant receiver having an aspirating or outlet tube extending downwardly within the tank or receiver with the outlet tube having a strainer or filter attached thereto and resting on the bottom of the receiver. In Yamamoto et al. the outlet tube extends downwardly through the filter, wherein the outlet tube terminates in a lower end positioned inside a recessed portion or sump of the receiver. Similarly, U.S. Pat. No. 4,827,725 to Morse teaches a suction accumulator having an improved dirt trap or filter to reduce the problems of dirt particles that cause premature mechanical failure of system components. In the Morse accumulator, a conduit includes a weir forming an upflow and downflow passage. The conduit extends downwardly within the accumulator and terminates with the filter. The filter includes a bottom that is located against the bottom of the vessel.

U.S. Pat. No. 4,474,035 to Amin et al. discloses an accumulator assembly having a U-shaped outlet tube with an oil return orifice and a filter assembly at a bight portion thereof. The filter assembly includes an integral clamp portion for maintaining a secure connection of the filter assembly to the outlet tube by means of a compressive clamping force. The clamp portion is curved so that split ends thereof surround the outlet tube and integrally fasten together. The filter assembly further includes a plastic housing that is integral with the clamp portion and includes a screen therearound. A metering tube within the filter assembly extends through the oil return orifice and extends in a direction transverse to the longitudinal axis of the accumulator assembly toward a wall of the accumulator housing. Similarly, U.S. Pat. No. 4,457,843 to Cullen et al. and U.S. Pat. No. 5,201,792 to Study disclose an accumulator having a filter assembly like that disclosed in Amin et al. wherein the filter is mounted to a bottom bend portion of a U-shaped pipe. In contrast, however, the bottom bend portion of the pipe is proximate a bottom wall of the accumulator such that the filter is in direct contact with the bottom wall.

U.S. Pat. No. 4,675,971 to Masserang discloses a refrigerant container body or accumulator having a U-shaped tube disposed therein. The U-shaped tube has a bend at a bottom portion thereof with a bleed hole that is enveloped by an annular screen assembly or filter. The filter has an inside diameter that allows it to fit closely around the tube and to be located against the inside of an end wall of the accumulator. Similarly, U.S. Pat. No. 4,938,037 to Carlisle, Jr. discloses an accumulator having a horseshoe style or U-shaped suction tube located therein. A filter is securely positioned about an oil recovery hole in the tube and is maintained in position against a bottom portion of the accumulator.

U.S. Pat. No. 5,660,058 to Harris et al. discloses an accumulator having an outlet tube that extends vertically adjacent an inner wall and includes a curved portion situated in a lowermost region of the accumulator adjacent a lower wall. An oil inlet tube is located at an end wall of the accumulator and extends in a direction along the longitudinal axis of the accumulator through the outlet tube and is surrounded by a filter assembly that is retained directly against the outlet tube. The Harris et al. patent teaches the use of a sump at the bottom of the accumulator where the oil inlet tube and filter extends as far as the bottom of a portion of the accumulator wall and extends beyond the wall into a sump that has been fabricated into the bottom wall of the accumulator assembly. Harris et al. teach that this configuration enables more oil to be introduced into the outlet tube to increase oil in the refrigerant mixture.

U.S. Pat. No. 5,970,738 to DeNolf et al. teaches an accumulator having a unique oil filter unit with an extended tube for reaching lower within the accumulator to use less oil. DeNolf et al. disclose that the oil filter unit is attached to a bight portion of an outlet tube within the accumulator. The oil filter unit is similar to that disclosed in Amin et al., Cullen et al., and Study and is attached to the outlet tube by a clamp portion. An oil pickup tube within the filter extends from within the outlet tube, through an aperture in the outlet tube, and downwardly toward the bottom of the accumulator. Thus, compared to previous devices, an end of the pickup tube is extended further down into the accumulator such that it is closer to the bottom of the accumulator to reduce the amount of oil required in the accumulator.

U.S. Pat. No. 5,778,697 to Wantuck is remarkably similar to DeNolf et al. Wantuck teaches use of a metering device for an accumulator that allows oil to be drawn into a return conduit practically to the bottom of the accumulator. The return conduit includes an opening in a lowermost curved portion thereof, wherein the opening faces downwardly toward a lower end wall of the accumulator. A filter assembly, similar to that of DeNolf et al., is mounted to the lowermost curved portion of the return conduit with an oil inlet tube having one end press fit into the opening in the lowermost curved portion of the return conduit and another end that is located proximate the lower end wall of the accumulator. A screen portion of the filter assembly includes a tubular portion surrounding the oil inlet tube and a bracket to secure the screen portion to the return conduit. Similar to Adams et al., a lower end cap of the filter assembly encloses a lower end of the screen portion and is disposed in contacting relation with an inside surface of the lower wall such that the filter assembly is supported on the lower end wall of the accumulator.

Unfortunately, most of the above-listed prior art references incorporate outlet tubes of various geometries that are composed of rigid material. Use of rigid material for the outlet tube requires carefully calculating and comparing the longitudinal dimensions of the outlet tube with respect to the interior longitudinal dimensions of the vessel. This is so that during manufacture of the vessel assembly, the filter attached to the outlet tube always locates against the bottom of the vessel and that the outlet tube is never too long so as to prevent proper assembling of the vessel assembly due to an interference condition. In other words, minimum and maximum material conditions of the vessel and its closure member must be compared to the minimum and maximum material conditions of the outlet tube to develop workable tolerances for each. Some accumulators, as described in some of the above-listed references, incorporate U-shaped outlet tubes that are dimensioned and manufactured short enough to avoid such an interference condition. Unfortunately, however, such accumulators do not have the oil filter assembly located against the bottom of the vessel.

One of ordinary skill in the art will readily recognize that if the outlet tube is too long with respect to the interior longitudinal dimensions of the vessel, the vessel assembly would be prevented from assembling completely or correctly due to the interference between the longitudinal extremities of the outlet tube and the longitudinal extremities of the vessel interior. Therefore, close tolerance stackups of the outlet tube, the vessel, and a vessel closure must be carefully calculated during design, and must be closely controlled in manufacturing operations to ensure a proper assembly. While calculating and specifying such tight tolerances on paper is rather simple and inexpensive, actually controlling such close tolerances in a factory is usually complex, expensive, and sometimes cost-prohibitive.

From the above, it can generally be appreciated that the refrigerant vessel assemblies of the prior art are not fully optimized to be more efficient while being less costly and easier to manufacture. Specifically, such devices often require tight tolerances to be controlled during manufacture of components to ensure proper assembly, thereby increasing production difficulties and related costs. Therefore, what is needed is a refrigerant vessel assembly that incorporates an outlet tube that is flexible and resilient, and is dimensioned so as to take up predetermined excess length of the outlet tube when the vessel assembly is assembled so that an oil pickup filter maintains position against the bottom of the accumulator regardless of tolerance stackups of the outlet tube and other various components of the accumulator.

BRIEF SUMMARY OF THE INVENTION

According to the preferred embodiment of the present invention, there is provided a vessel assembly including a vessel that has an interior portion. The vessel also includes an inside bottom surface or end and a vessel closure member is provided that defines an inside top portion of the vessel. A flexible conduit assembly is disposed within the interior of the vessel such that an upper end of the flexible conduit assembly is connected to the inside top portion of the vessel. The flexible conduit assembly further includes a distal end that is located against the inside bottom surface of the vessel. Due to the resiliency of the flexible conduit assembly, the distal end of the flexible conduit assembly stays located against the inside bottom surface of the vessel regardless of dimensional variations of the flexible conduit assembly, the vessel, and the closure member. Additionally, the present invention also encompasses a method of manufacturing the vessel assembly described above.

It is an object of the present invention to provide a pressure vessel assembly that has a more tolerant design and assembly process than prior art devices in the same class.

It is another object to provide a pressure vessel assembly wherein a filter unit locates against the inside bottom surface of the vessel assembly and an outlet tube deflects without breaking during assembly to compensate for extra length of the outlet tube compared to axial inside length dimensions of the vessel.

It is a still another object to provide a pressure vessel that is capable of being automatically assembled.

It is yet another object to provide a method for manufacturing the pressure vessel of the present invention, wherein the method is more simple and less costly than prior art methods.

It is a further object to provide a J-tube within an accumulator that flexes during assembly to comply and conform with the inside of the accumulator.

It is still a further object to provide a pressure vessel design for use in an air-conditioning system that includes a minimum number of parts, is less expensive to manufacture than prior art designs, and can be manufactured using readily available lightweight materials.

It is yet a further object to provide more efficient use of lubricating oil within an accumulator to reduce the overall cost of the air-conditioning system.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
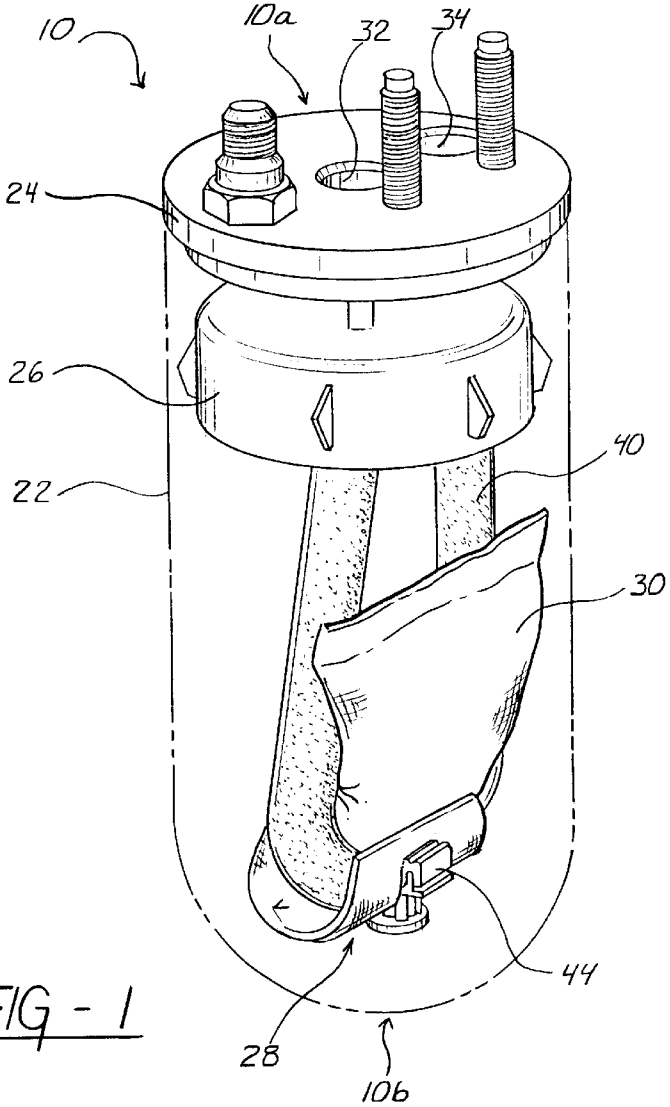
FIG. 1 is a perspective view of an accumulator assembly according to the preferred embodiment of the present invention.

Referring generally to the present invention, an improved vessel assembly is provided for use in an automotive air-conditioning system that includes a compressor, a condenser, and an evaporator as is well known in the art. Referring now to the FIGS. and specifically to FIG. 1, an accumulator assembly 10 includes a vessel or can 22, a cover or puck 24, a baffle or deflector 26, an outlet tube assembly or conduit assembly 28, and a desiccant bag 30. The accumulator assembly 10 has a first end 10*a* and an oppositely disposed second end 10*b*.

Figure 2:
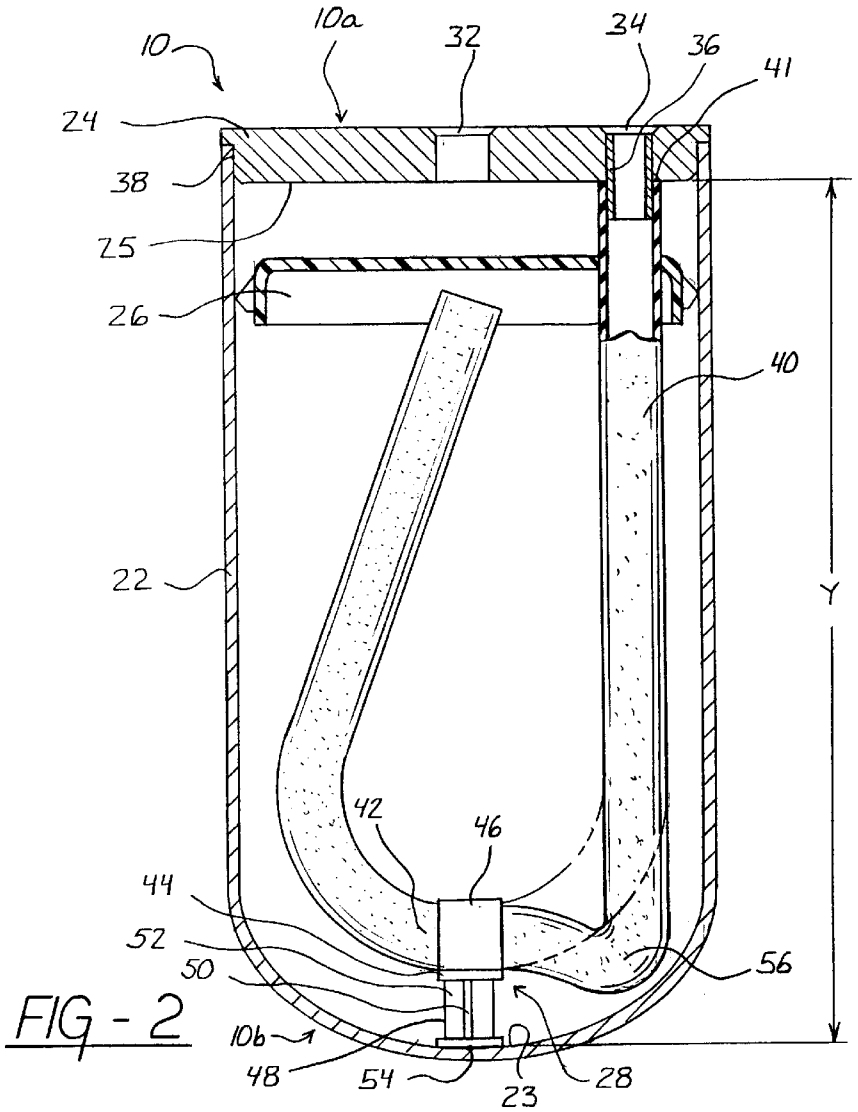
FIG. 2 is a cross-sectional view of the accumulator assembly of FIG. 1.

Referring now to FIG. 2, the can 22 is preferably made from a light alloy material, such as aluminum, of a quality and grade appropriate for accumulators. The can 22 is generally cylindrical and manufactured from sheet stock using a deep draw process, or from tube stock that is spun closed at one end to define an interior cavity that is open-ended opposite the closed end. The second end 10*b* of the accumulator assembly 10 is formed in the can 22 during the deep draw or spin closing process such that an inside bottom surface 23 is established. U.S. Pat. No. 5,375,327 to Searfoss et al., assigned to the assignee hereof, is incorporated by reference herein as an example of a spin closing process that could be used in part with the present invention. Deep draw processes have long been well known to those of ordinary skill in the art and need not be further discussed herein.

The top portion or first end 10*a* of the accumulator assembly 10 is formed by the closure member or puck 24 of the present invention. The puck 24 can be manufactured using any known appropriate process, however, the puck 24 is preferably manufactured using a machining process. The puck 24 includes an inlet opening 32 and an outlet opening 34 that have an external inlet hose (not shown) and an external outlet hose (not shown) connected thereto, respectively, for connection to the automotive air-conditioning system. The outlet opening 34 includes a connector sleeve 36 pressed therein and extending into the interior cavity of the accumulator assembly 10. The puck 24 includes a reduced diameter portion 38 that mates with the open end of the can 22 and is connected to the can 22 using a M.I.G. welding process or other appropriate process for welding the can 22 to the puck 24 as is well known in the art. The puck 24 includes an inner surface 25, whereby an inside longitudinal dimension Y is defined between the inner surface 25 and the inside bottom surface 23 of the can 22.

The deflector 26 of the present invention has a general inverted cup shape, and is preferably manufactured from a thermoplastic material such as nylon. However, it is possible to use a metal or alloy material. The deflector 26 is mounted between the puck 24 and the outlet tube assembly 28 as is well known in the art, to direct refrigerant flow incoming through the inlet opening 32 towards the inner surface of the can 22. U.S. Pat. No. 5,746,065 to Patel et al., assigned to the assignee hereof, discloses connections between outlet tubes, deflectors, and closure members, and is incorporated by reference herein.

Referring again to FIG. 1, the desiccant bag 30 is connected to the outlet tube assembly 28 in any known manner. Preferably, the desiccant bag 30 is pre-assembled to the outlet tube assembly 28 such that the desiccant bag 30 is carried by the outlet tube assembly 28 and can be inserted within the can 22 during assembly of the accumulator assembly 10. Such a desiccant bag 30 connection is disclosed in co-pending application Ser. No. 09/941,482 filed concurrently herewith and incorporated by reference herein.

Referring back to FIG. 2, the outlet tube assembly 28 of the present invention is disposed within the interior cavity of the can 22 and includes a J-shaped tube or conduit, referred to herein as a J-tube 40. The J-tube 40 is necessarily resiliently flexible and is composed of a semi-rigid, semi-flexible conduit material, examples of which include polyethylene, Teflon®, and silicone tubing. Accordingly, the J-tube 40 should not be invincibly rigid, but should be rigid to some degree such that it flexes and is compliant to various configurations. While it is contemplated that the J-tube could be so formed in multitudes of ways, preferably, the J-tube 40 is formed by providing extruded tube stock, bending the tube stock to the desired J shape, and heating the tube stock in its bent J shape to give the J-tube 40 a baseline shape and memory. Accordingly, the J-tube 40 is rigid enough to retain its J shape on its own without requiring an external applied force of any kind. Yet, the J-tube 40 is flexible enough to bend without breaking when a force is applied thereto, and is able to withstand the high pressure operating environment within the accumulator assembly 10. In other words, the J-tube 40 is capable of withstanding shock without permanent deformation or rupture and returns freely to its J-shape thereafter.

An upper end 41 of the J-tube 40 is press fit to the connector sleeve 36 of the puck 24 and, thereby, is in fluid communication with the outlet opening 34. The J-tube 40 includes a bight portion 42 at a lower end of the J-tube 40, generally axially opposite of the upper end 41. The bight portion 42 includes an oil return orifice (not shown) therethrough that faces axially downwardly toward the second end 10*b* of the accumulator assembly 10. An oil pickup filter 44 is in fluid communication with the oil return orifice wherein the accumulator assembly 10 siphons oil through the oil pickup filter 44 and the oil return orifice to expel oil through the outlet opening 34 for lubrication of the compressor, as is well known in the art. The oil pickup filter 44 used with the present invention is preferably consistent with the filter disclosed in U.S. Pat. No. 5,970,738 to DeNolf et al., assigned to the assignee hereof, and incorporated by reference herein. The oil pickup filter 44 is preferably a standard Hutchinson part number 199980/83 having a clamp or clip portion 46 that circumscribes the bight portion 42 as is well known in the art. The oil pickup filter 44 has a screen body 48 extending integrally from the clip portion 46 and including a screen frame 50, a mesh or screen 52, and a disc portion 54. The disc portion 54 of the oil pickup filter 44 establishes a distal end of the outlet tube assembly 28, generally axially opposite of the upper end 41, and locates against the inside bottom surface 23 of the can 22. It has been long recognized, as evidenced by most of the patents described in the background of the present invention, that it is desirable to locate the oil pickup filter 44 against the inside bottom surface 23 of the accumulator assembly 10, to achieve optimum oil siphoning since oil settles out at the lowermost portion of the accumulator assembly 10. Accordingly, the outlet tube assembly 28 has a predetermined longitudinal dimension defined by the overall axial length across the upper end 41 of the outlet tube assembly 28 and the bottom-most portion of the disc portion 54 of the oil pickup filter 44.

The J-tube 40 is necessarily flexible so as to bend, as indicated by the bent portion 56, and take up the difference between the predetermined longitudinal dimension of the outlet tube assembly 28 and the longitudinal inside dimension Y of the accumulator assembly 10 when the outlet tube assembly 28 is assembled within the can 22. The accumulator assembly 10 is dimensioned so that under a minimum material condition of the J-tube 40 and the puck 24 and a maximum material condition of the can 22, the bottom of the oil pickup filter 44 just barely locates against the inside bottom surface 23 of the can 22, wherein the J-tube 40 does not bend beyond the conventional J-tube shape, as shown in phantom. In contrast, however, under a maximum material condition of the J-tube 40 and the puck 24 and a minimum material condition of the can 22, the oil pickup filter 44 remains located against the inside bottom surface 23 of the can 22 and the J-tube 40 bends to conform within the can 22 to result in the bent portion 56.

Accordingly, the oil pickup filter 44 stays located against the inside bottom surface 23 of the can regardless of dimensional variations of the outlet tube assembly 28, the can 22, and the puck 24. As a result, the oil pickup filter 44 is located as far down as possible within the can 22 such that a pickup tube (not shown) within the oil pickup filter 44 is extended as close to the inside bottom surface 23 as workably possible. Extending the pickup tube further down allows less oil to be used within the accumulator assembly 10 for a reduction in oil cost savings. Furthermore, using a flexible J-tube 40, rather than the rigid J-tubes of the prior art, results in a more compliant accumulator assembly. Otherwise, the length of a rigid J-tube and the interior dimensions of the rest of the accumulator assembly 10 would have to be precisely controlled so as to consistently locate the oil pickup filter 44 against the inside bottom surface 23 of the can 22.

A method of manufacturing the accumulator assembly 10 described above preferably involves the above-listed components and further includes the following listed steps. The desiccant bag 30 is assembled to the outlet tube assembly 28 as described in copending application Ser. No. 09/941,482. The deflector 26 is assembled to the flexible J-tube 40 as is well known in the art. The upper end 41 of the outlet tube assembly 28 is assembled to the puck 24 by pressing the upper end 41 over the outer diameter of the connector sleeve 36. Then, the assembled puck 24, outlet tube assembly 28, desiccant bag 30, and deflector 26 are inserted together into the can 22 such that the oil pickup filter 44 locates against the inside bottom surface 23 of the can 22. Next, the assembled puck 24 and outlet tube assembly 28 are axially advanced further into the can 22 until a portion of the puck 24 locates against a portion of the can 22 to close the can 22, such that the flexible J-tube 40 bends in compliance to maintain the oil pickup filter 44 in location against the inside bottom surface 23 of the can 22. Finally, the puck 24 is welded to the can 22 to close the can 22 and define the accumulator assembly 10, such that the outlet tube assembly 28 takes up the difference between the overall longitudinal dimension of the outlet tube assembly 28 and the inside longitudinal dimension Y defined by the puck 24 and the inside bottom surface 23 of the can 22 so that the oil pickup filter 44 maintains location against the inside bottom surface 23 of the can 22 regardless of dimensional variations of the outlet tube assembly 28, the can 22, and the puck 24.

While the present invention has been described in terms of a preferred embodiment, it is apparent that other forms could be adopted by one skilled in the art. For example, the teachings and disclosure of the present invention encompass any reasonable substitutions or equivalents of claim limitations. For example, the term vessel covers any container structure. Additionally, the terms resilient, flexible, elastic, and the like are essentially synonomous and herein are taken to mean that which flexes and recovers its shape as described previously above. Those skilled in the art will appreciate that other applications, including those outside of the automotive industry, are possible with this invention. Accordingly, the present invention is not limited to only automotive air-conditioning accumulators or receivers. Accordingly, the scope of the present invention is to be limited only by the following claims.

What is claimed is:

1. A vessel assembly comprising:

a vessel defining an interior cavity, said vessel having at one end an inside top portion and at an opposite end an inside bottom portion; and a flexible conduit assembly disposed within said interior cavity of said vessel, said flexible conduit assembly having one end connected to said inside top portion of said vessel and a distal portion opposite said one end, said distal portion of said flexible conduit assembly further having a filter member, said distal portion of said flexible conduit assembly being located against said inside bottom portion of said vessel;

whereby regardless of the dimensional variation of said flexible conduit assembly and said vessel, said distal portion of said flexible conduit assembly remains in contact with said inside bottom portion of said vessel.

2. The vessel assembly as claimed in claim 1, wherein said flexible conduit assembly comprises a flexible conduit, said flexible conduit having a bight portion and an orifice located within said bight portion.

3. The vessel assembly as claimed in claim 2, wherein said flexible conduit is composed of silicone tubing.

4. The vessel assembly as claimed in claim 2, wherein said filter member is in fluid communication with said orifice of said flexible conduit such that said vessel assembly draws oil through said filter and into said flexible conduit.

5. The vessel assembly as claimed in claim 1, further comprising an intermediate connector sleeve connecting said inside top portion of said vessel to said one end of said flexible conduit assembly.

6. A vessel assembly for a refrigeration system, said vessel assembly comprising:

a vessel defining an interior cavity having at one end a top portion and at an opposite end an inside bottom portion;

a closure member mounted to said top portion of said vessel, said closure member having a passage; and a flexible conduit assembly disposed within said interior cavity of said vessel, said flexible conduit assembly having one end mounted in said passage of said closure member and a distal portion opposite said one end, said distal portion of said flexible conduit assembly further having a filter member, said distal portion of said flexible conduit assembly being in direct contact with said inside bottom portion of said vessel;

whereby regardless of dimensional variations of said flexible conduit assembly, said vessel, and said closure member, said distal portion of said flexible conduit assembly remains in contact with said inside bottom portion of said vessel.

7. The vessel assembly as claimed in claim 5, wherein said flexible conduit assembly comprises a flexible conduit, said flexible conduit having a bight portion and an orifice located within said bight portion.

8. The vessel assembly as claimed in claim 7, wherein said flexible conduit is composed of silicone tubing.

9. The vessel assembly as claimed in claim 7, wherein said filter member is in fluid communication with said orifice of said flexible conduit such that said vessel assembly draws oil through said filter and into said flexible conduit.

10. The vessel assembly as claimed in claim 6, further comprising an intermediate connector sleeve connecting said passage of said closure member to said one end of said flexible conduit assembly.

11. An accumulator assembly for an automotive air-conditioning system, said accumulator assembly comprising:

a generally cylindrical refrigerant vessel defining an interior cavity and having a longitudinal axis, said refrigerant vessel having a closure member mounted thereto for closing said refrigerant vessel, said closure member having an inner surface and an outlet therethrough, said refrigerant vessel having an inside bottom surface within said interior cavity, said refrigerant vessel having an inside longitudinal dimension defined by a distance between said inner surface of said closure member and said inside bottom surface; and an outlet tube assembly disposed within said interior cavity of said refrigerant vessel, said outlet tube assembly comprising a semi-rigid J-tube having one end connected to said closure member of said refrigerant vessel in fluid communication with said outlet, said semi-rigid J-tube further having a bight portion with a pickup filter attached thereto in fluid communication with said semi-rigid J-tube, whereby said accumulator assembly draws oil through said pickup filter and into said semi-rigid J-tube, said pickup filter being located against said inside bottom surface of said refrigerant vessel, said outlet tube assembly having a predetermined longitudinal dimension defined by the overall axial length from said one end to and including the axial length of said pickup filter;

said outlet tube assembly being flexible so as to bend and take up any variation in length due to tolerance variations of said predetermined longitudinal dimension of said outlet tube assembly and said refrigerant vessel when said refrigerant vessel assembly is assembled so that said pickup filter maintains direct contact against said inside bottom surface of said refrigerant vessel regardless of dimensional tolerance variations of said outlet tube assembly, said refrigerant vessel, and said refrigerant closure member.

12. A method of manufacturing a vessel assembly, said method comprising the steps of:

providing a vessel of generally cylindrical shape, said vessel defining an interior cavity and having an inside bottom surface;

providing a closure member for closing said vessel, said closure member having an inner surface and at least one passage therethrough, said closure member defining an inside longitudinal dimension of said vessel between said inner surface of said closure member and said inside bottom surface of said vessel;

providing a flexible conduit assembly for connecting to said closure member, said flexible conduit assembly comprising a flexible conduit with an upper end and a lower end approximately opposite said upper end, said flexible conduit assembly further having a filter at said lower end of said flexible conduit, said filter having a bottom, said flexible conduit assembly having a predetermined longitudinal dimension defined by the axial length from said upper end of said flexible conduit to said bottom of said filter;

assembling said upper end of said flexible conduit assembly to said closure member;

inserting the assembled closure member and flexible conduit assembly into said interior cavity of said vessel such that said filter locates against said inside bottom surface of said vessel;

axially advancing the assembled closure member and flexible conduit assembly further into said vessel until a portion of said closure member abuts against a portion of said vessel, such that said flexible conduit assembly bends in compliance to maintain said filter located against said inside bottom surface of said vessel; and closing said vessel with said closure member, whereby said flexible conduit assembly flexes to take up the difference between said predetermined longitudinal dimension of said flexible conduit assembly and said inside longitudinal dimension of said vessel so that said filter maintains contact against said inside bottom surface of said vessel regardless of dimensional variations of said flexible conduit assembly, said vessel, and said closure member.

* * * * *

UNITED STATES PATENT AND TRADEMARK OFFICE

CERTIFICATE OF CORRECTION

PATENT NO. : 6,438,972 B1
DATED : August 27, 2002
INVENTOR(S) : Pickett, Jr. et al.

It is certified that error appears in the above-identified patent and that said Letters Patent is hereby corrected as shown below:

Title page,
Item [74], kindly delete "Vanophem & Vanophem", and insert
-- VanOphem & VanOphem --.

Column 1,
Line 8, kindly delete "accumlatordehy-drator", and insert
-- accumulator-dehydrator --.
Lines 24 and 40, after "F", kindly delete the period ".".

Signed and Sealed this

Eighth Day of April, 2003

JAMES E. ROGAN
*Director of the United States Patent and Trademark Office*